US012497854B2

(12) United States Patent
Gutterres

(10) Patent No.: US 12,497,854 B2
(45) Date of Patent: Dec. 16, 2025

(54) COMPLETION SYSTEM FOR CCS MONITORING

(71) Applicant: Welltec Manufacturing Center Completions ApS, Esbjerg N (DK)

(72) Inventor: Fabio Rosas Gutterres, Esbjerg N (DK)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 18/674,343

(22) Filed: May 24, 2024

(65) Prior Publication Data

US 2024/0392646 A1 Nov. 28, 2024

(30) Foreign Application Priority Data

May 26, 2023 (EP) ..... 23175827
Jun. 26, 2023 (EP) ..... 23181478

(51) Int. Cl.
*E21B 33/127* (2006.01)
*E21B 41/00* (2006.01)
*E21B 47/00* (2012.01)

(52) U.S. Cl.
CPC ..... *E21B 33/127* (2013.01); *E21B 41/0064* (2013.01); *E21B 47/00* (2013.01)

(58) Field of Classification Search
CPC ..... E21B 33/12–1285; E21B 17/026
See application file for complete search history.

(56) References Cited

U.S. PATENT DOCUMENTS

2009/0250228 A1* 10/2009 Loretz ..... E21B 33/12 166/387
2016/0348463 A1* 12/2016 Vasques ..... E21B 33/1277
2017/0145777 A1* 5/2017 Vasques ..... E21B 43/14
2020/0040693 A1 2/2020 Vasques
2020/0072018 A1* 3/2020 Roselier ..... E21B 34/101
2023/0003097 A1* 1/2023 Vasques ..... E21B 33/122
2023/0147260 A1 5/2023 Vasques

FOREIGN PATENT DOCUMENTS

EP 3187682 A1 7/2017

OTHER PUBLICATIONS

Extended European Search Report for EP 23175827.7, dated Oct. 30, 2023, 11 pages.

* cited by examiner

*Primary Examiner* — Kristyn A Hall
(74) *Attorney, Agent, or Firm* — Nixon & Vanderhye P.C.

(57) ABSTRACT

A completion system for $CO_2$ storage monitoring includes a first well tubular metal structure, a second well tubular metal structure, cement arranged between the borehole and a second part of the second well tubular metal structure, a monitoring line extending along the second well tubular metal structure and into the cement, a production packer assembly providing a seal between the first and second well tubular metal structures, the production packer assembly having an anchoring unit, and an annular barrier unit. Each unit comprises a tubular metal part configured to be mounted as part of a first part of the second well tubular metal structure, the tubular metal part having an expandable metal sleeve having a circumferential groove with an anchoring element and a sealing element. The monitoring line extends through the anchoring and annular barrier units between the tubular metal part and the expandable metal sleeve.

16 Claims, 10 Drawing Sheets

COMPLETION SYSTEM FOR CCS MONITORING

CROSS-REFERENCE TO RELATED APPLICATIONS

Figure 1:
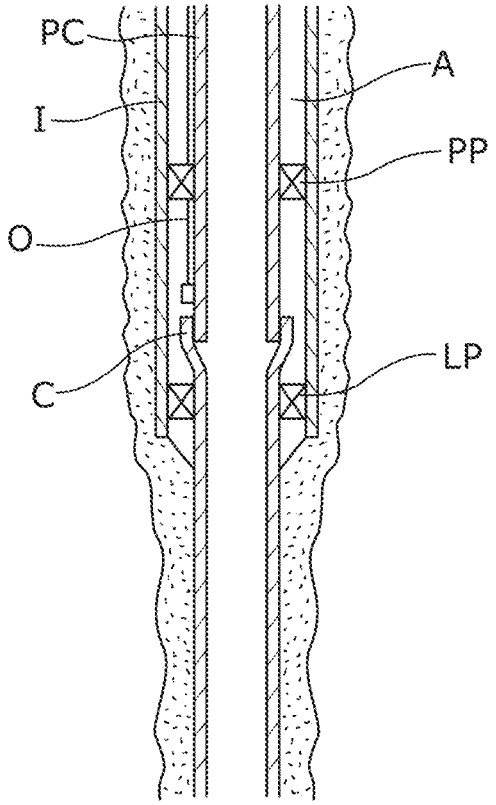
Fig. 1 Prior Art

This application claims priority to European patent applications EP 23175827.7 filed May 26, 2023, and EP 23181478.1 filed Jun. 26, 2023, the entire contents of each of which are hereby incorporated by reference.

DESCRIPTION

The present invention relates to a completion system for $CO_2$ storage monitoring in a reservoir in a formation, the completion system being arranged in a borehole having a top and extending towards the reservoir. The invention also relates to a completion method for completing a well to be ready for $CO_2$ storage monitoring in a reservoir in a formation.

Carbon Capture Storage (CCS) in old oil & gas reservoirs is highly prioritised as the world produces too much $CO_2$. The storing of $CO_2$ requires that the reservoirs are maintained substantially the same so that the $CO_2$ remains stored in the formation over at least 70 years. The formation in which the reservoirs are located may change over time due to naturally occurring forces and also due to human-induced factors. Thus, it is important that the reservoir and movements of the formation are monitored so that the storing of $CO_2$ is under control.

The production of oil & gas from reservoirs is performed from wells, and when completing new wells, some of them need to be made ready for CCS and thus also for the monitoring of movements and other factors in the well. The monitoring of movements in the reservoir requires strain measurements which may be carried out by means of a fibre optic line along the outer face of the production casing.

In order to provide the barriers required to prevent blowouts, wells are often cemented. The production packer in the top of the well is not approved for being run in with the tubing through which the cement job is performed since the internal surface of the intermediate casing against which the production packer is to seal is no longer clean enough for the known production packers to be sealingly set. This may be due to cement or other residues in the fluid displaced upwards when cementing. Therefore, cemented wells need to be designed with a liner run in the production casing with a running tool and connected to surface via a drill pipe. The cement is then pumped down the drill pipe and the liner and displaced in the openhole annulus area covering the lower section of the production casing, pushing the drilling mud, spacer, etc., up in the annulus inside the production casing. After the liner hanger and packer system has been set, hanging off from the production casing, the running tool is released and pulled out of hole with the drill pipe. With the formation isolated, the drilling fluid in the well is displaced by a clean fluid (packer fluid). Then, the production string with the production packer is run in and connected with the top of the liner, and the production packer assembly is set in the clean inner face of the production casing as this part has not been in contact with the cement.

Some production packers may have "feed through", which allows downhole monitoring with monitoring lines such as fibre optic lines, electric lines or similar lines. However, no connection is possible in the A annulus across the liner hanger and packer system, and therefore no solution exists at present allowing monitoring lines (e.g. fibre optic or electric lines) to extend all the way down to the cemented part of the well in the reservoir section. In $CO_2$ storage wells, where MMV requirements are typically high in terms of types of monitoring solution as well as lifespan, the lifespan can exceed 70 years in certain CCS projects.

It is an object of the present invention to wholly or partly overcome the above disadvantages and drawbacks of the prior art. More specifically, it is an object to provide an improved completion solution for producing oil or gas that is compatible for CCS monitoring when the well is used for storing $CO_2$ in the abandoned reservoir.

The above objects, together with numerous other objects, advantages and features, which will become evident from the below description, are accomplished by a solution in accordance with the present invention by a completion system for $CO_2$ storage monitoring in a reservoir in a formation, the completion system being arranged in a borehole having a top and extending towards the reservoir, the completion system comprising:

- a first well tubular metal structure having a first inner diameter,
- a second well tubular metal structure having a first part arranged within the first inner diameter of the first well tubular metal structure and a second part extending below the first well tubular metal structure into the borehole,
- a monitoring line, such as a fibre optic line or an electric line, extending from the top along both the first and the second part of the second well tubular metal structure and into the cement, and
- a production packer assembly providing a seal between the first well tubular metal structure and the first part of the second well tubular metal structure, the production packer assembly comprising:
  - an anchoring unit, and
  - an annular barrier unit, wherein each unit comprises:

- a tubular metal part configured to be mounted as part of the first part of the second well tubular metal structure, the tubular metal part having an outer face and an axial extension along the second well tubular metal structure, and
- an expandable metal sleeve surrounding the tubular metal part, the expandable metal sleeve having a circumferential groove, a first end and a second end, each end of the expandable metal sleeve being connected with the outer face of the tubular metal part, the tubular metal part comprising an opening through which fluid passes to expand the expandable metal sleeve, wherein the anchoring unit further comprises an anchoring element arranged in the circumferential groove, the anchoring element comprising a first anchoring part at least partly overlapping a second anchoring part in a radial direction perpendicular to the axial extension so that an inner face of the first anchoring part at least partly abuts an outer face of the second anchoring part, wherein the annular barrier unit further comprises a sealing element arranged in the circumferential groove, and wherein the monitoring line, such as fibre optic or electric lines, extend through both the anchoring unit and the annular barrier unit between the tubular metal part and the expandable metal sleeve.

By having a production packer assembly with an anchoring unit and an annular barrier unit having expandable metal sleeves and a monitoring line, such as fibre optic or electric lines, extending through both the anchoring unit and the annular barrier unit between the tubular metal part and the expandable metal sleeve, the production casing, i.e. the first well tubular metal structure, does not have to be flushed with brine after drilling, soiling the completion, as the production packer assembly can be set in any dirty production casing.

Furthermore, the completion system may comprise cement arranged between the borehole and the second part of the second well tubular metal structure.

Moreover, the annular barrier unit may be a first annular barrier unit, and the completion system may further comprise a second annular barrier unit arranged further down the first part than the first annular barrier unit for providing a seal between the first and the second well tubular metal structure.

Further, the second annular barrier unit may provide a second barrier against the cement arranged below the first well tubular metal structure.

Also, the completion system may further comprise a third annular barrier unit arranged so that the tubular metal part thereof is mounted as part of the second part of the second well tubular metal structure.

In addition, the expandable metal sleeve of the third annular barrier unit may be expanded in the non-cured cement.

Furthermore, the completion system may also comprise a flow control assembly fluidly connected to an aperture in the first part of the second well tubular metal structure for controlling the flow of fluid from an inside of the second well tubular metal structure to an annulus between the first and the second well tubular metal structure.

Moreover, the flow control assembly may be arranged between the production packer assembly and the second annular barrier unit.

Further, the second part of the second well tubular metal structure may have a first length, and the monitoring lines, such as fibre optic or electric lines, may extend along the second part along at least 60% of the first length.

Also, the second well tubular metal structure may comprise clamps for fastening the monitoring lines, such as fibre optic or electric lines, to an outer face of the second well tubular metal structure.

In addition, the completion system may further comprise a second monitoring line such as a fibre optic or an electric line extending along the second well tubular metal structure.

Furthermore, the completion system may also comprise an intermediate casing having a second length and being arranged to circumferent the first well tubular metal structure, the intermediate casing extending from the top along at least 50% of the second length, and a fourth annular barrier unit arranged between the intermediate casing and the first well tubular metal structure.

Moreover, the fourth annular barrier unit may be set in non-cured cement.

Further, the completion system may also comprise other annular barrier units so that the tubular metal parts thereof form part of the second part of the second well tubular metal structure.

Also, the completion system may further comprise a flow valve mounted as part of the second well tubular metal structure so that production fluid from the reservoir flows into the second well tubular metal structure.

In addition, the completion system may further comprise a strain sensor.

Furthermore, the completion system may also comprise a temperature/pressure sensor.

Moreover, the second well tubular metal structure may comprise perforations.

Further, the invention relates to a completion method for completing a well to be ready for $CO_2$ storage monitoring in a reservoir in a formation, comprising:

introducing a first well tubular metal structure of a completion system, mounting the second well tubular metal structure with the monitoring line extending along both the first and second parts of the second well tubular metal structure, and mounting the tubular metal part of the anchoring unit and the annular barrier unit to form part of the second well tubular metal structure, introducing the second well tubular metal structure with a production packer assembly and the monitoring line, the second well tubular metal structure being arranged within the first inner diameter of the first well tubular metal structure, and the second part extending below the first well tubular metal structure into the borehole, running cement down the second well tubular metal structure and further between the borehole and the second part of the second well tubular metal structure, and setting the production packer assembly by pressurising fluid in the second well tubular metal structure and letting the fluid into the openings of the anchoring unit and the annular barrier unit, thereby expanding the expandable metal sleeve so that the sealing element of the annular barrier unit and the anchoring element of the anchoring unit abut against an inner face of the first well tubular metal structure.

Also, the monitoring line may extend through both the anchoring unit and the annular barrier unit between the tubular metal part and the expandable metal sleeve.

In addition, before setting the production packer assembly, the completion method may comprise cleaning the annulus between the first and the second well tubular metal structure by letting fluid in through an aperture of a flow control assembly arranged below the production packer assembly.

Furthermore, before letting fluid in through an aperture of a flow control assembly arranged below the production packer, the completion method may comprise setting a plug inside the second well tubular metal structure below the flow control assembly.

Moreover, before letting fluid in through the aperture of the flow control assembly, the completion method may comprise setting a second annular barrier unit by letting fluid into the opening in the tubular metal part to expand the expandable metal sleeve so that the sealing element abuts the first well tubular metal structure.

Further, the completion method may also comprise mounting a fourth annular barrier unit so that the tubular metal part thereof forms part of the first well tubular metal structure.

Also, before arranging the second well tubular metal structure in the first well tubular metal structure, the first well tubular metal structure may be pressurised so that fluid flows in through an opening in the tubular metal part, expanding the expandable metal sleeve to abut the intermediate casing.

In addition, the anchoring element may be a circumferential anchoring element.

Moreover, the inner face of the first anchoring part and the outer face of the second anchoring part may be inclined in relation to the axial extension.

By having the inner face of the first anchoring part and the outer face of the second anchoring part inclined in relation to the axial extension, it is obtained that when at least part of the expandable metal sleeve moves in one direction along the axial direction, the first anchoring part moves in an opposite direction along the inclined outer face of the second anchoring part, and the first anchoring part is then forced radially outwards, anchoring the expandable metal sleeve even further to another well tubular metal structure or the wall of the borehole.

Furthermore, the first anchoring part and the second anchoring part may be one monolithic whole.

Additionally, the first anchoring part and the second anchoring part may be one monolithic whole, the first anchoring part and the second anchoring part forming a key ring where the first anchoring part is one end of the key ring, and the second anchoring part is the other end of the key ring.

Moreover, the annular barrier unit and/or the anchoring unit may further comprise a connection element arranged between the tubular metal part and the expandable metal sleeve, and the connection element may be connected with the tubular metal part and the expandable metal sleeve.

Furthermore, the monitoring line may extend though the connection element.

In addition, the expandable metal sleeve may be divided into at least two parts, and each part may be connected to the connection element.

Further, the connection element may be arranged opposite the circumferential groove.

Also, the sealing element may be ring-shaped with a trapeze cross-sectional shape.

In addition, the anchoring element may comprise a third anchoring part having an outer face abutting a second inner face of the first anchoring part so that the first anchoring part is arranged between the third anchoring part and the second anchoring part, and the inner face of the third anchoring part and the inner face of the second anchoring part face and abut the circumferential groove.

According to the present invention, the anchoring unit may further comprise a second anchoring element comprising a first anchoring part at least partly overlapping a second anchoring part in a radial direction perpendicular to the axial extension so that an inner face of the first anchoring part at least partly abuts an outer face of the second anchoring part, the inner face of the first anchoring part and the outer face of the second anchoring part being inclined in relation to the axial extension in an opposite direction, i.e. a direction opposite to that of the first anchoring element.

Thus, the inner face of the first anchoring part of the first anchoring element may be inclined facing upwards towards the top of the well, the inner face of the first anchoring part of the second anchoring element being inclined facing downwards away from the top of the well. By having a first anchoring element with an inclined inner face of the first anchoring part in one direction and a second anchoring element with an inclined face of the first anchoring part in an opposite direction, the anchoring unit can withstand axial loads in both directions along the axial extension as the first anchoring element is activated when the axial load is in one direction, and the second anchoring element is activated when the axial load pulls in the opposite direction.

Also, the expandable metal sleeve may have a second circumferential groove in which a sealing element is arranged.

Additionally, the sealing element may comprise a sealing element made of e.g. elastomer.

Moreover, the sealing element may further comprise a back-up ring-shaped element and a key ring element.

Finally, the expandable metal sleeve may comprise at least two sealing elements, the anchoring element being arranged between two sealing elements.

Figure 2:
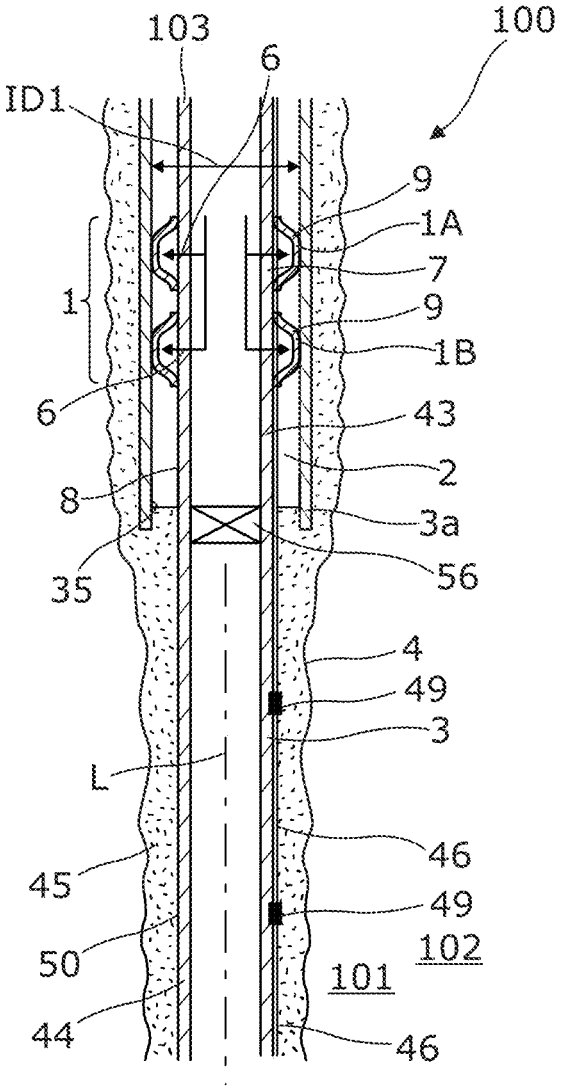
Figure 3C:
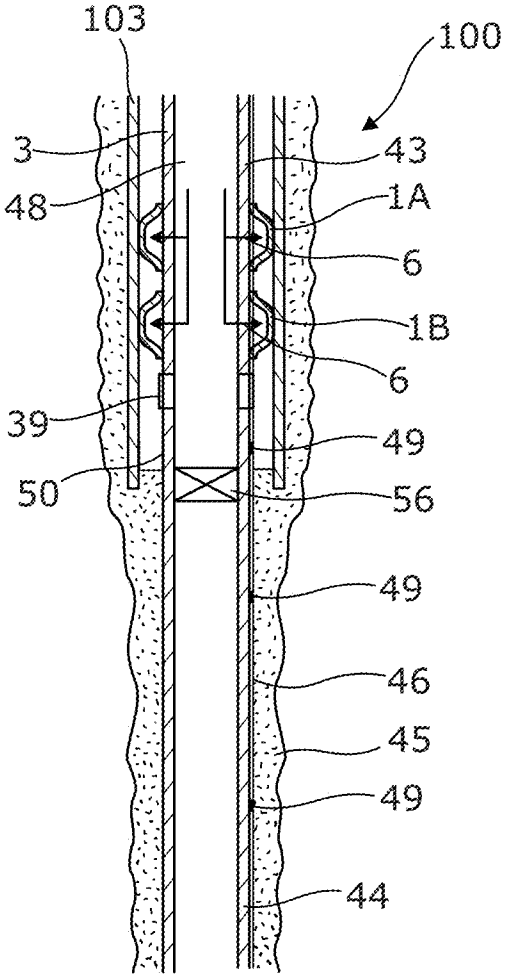
Figure 3B:
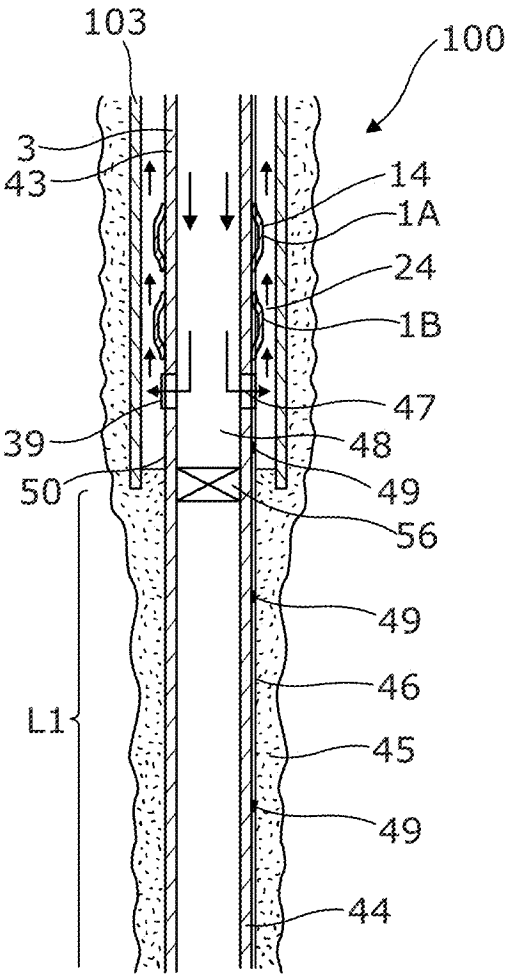
Figure 3A:
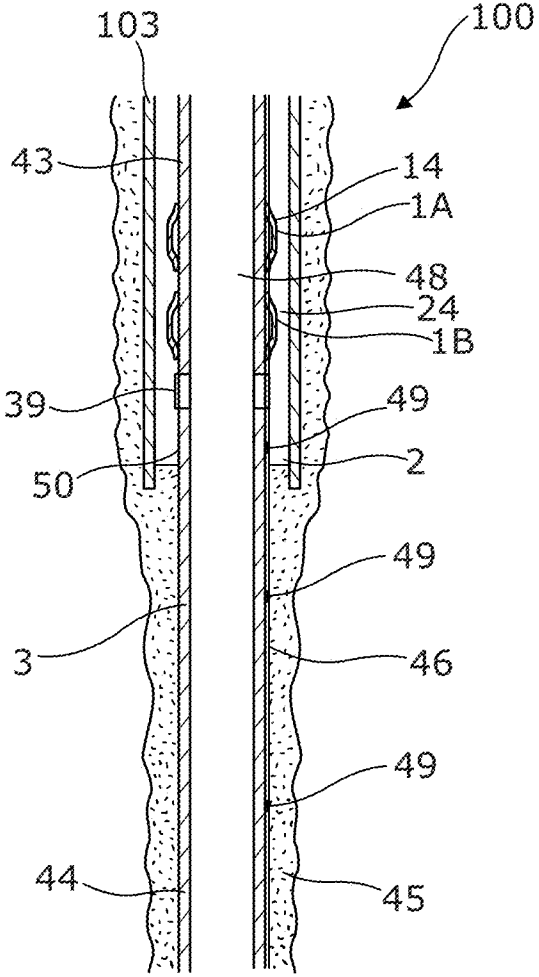
Figures 4A, 4B, 4C, 4D:
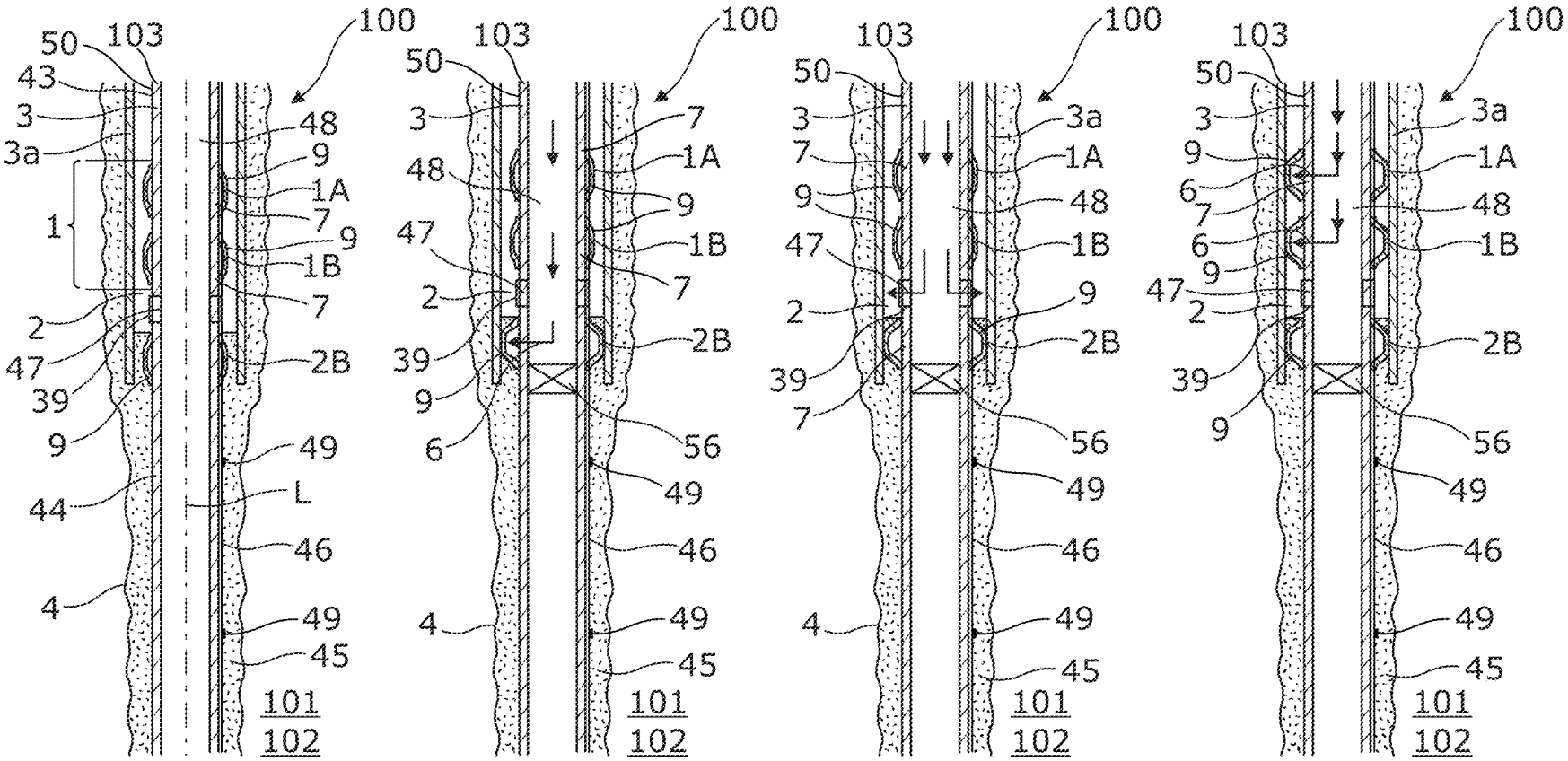
Figure 5:
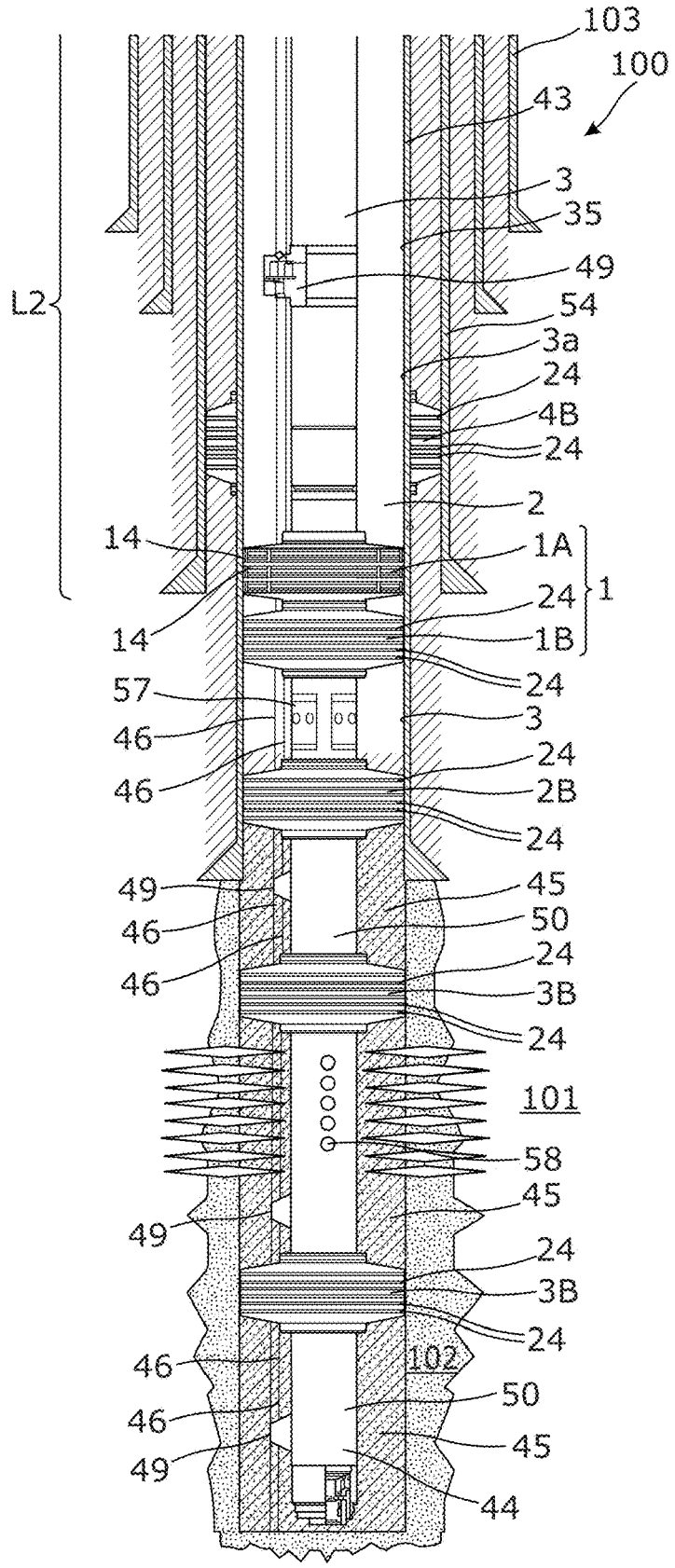
Figure 6:
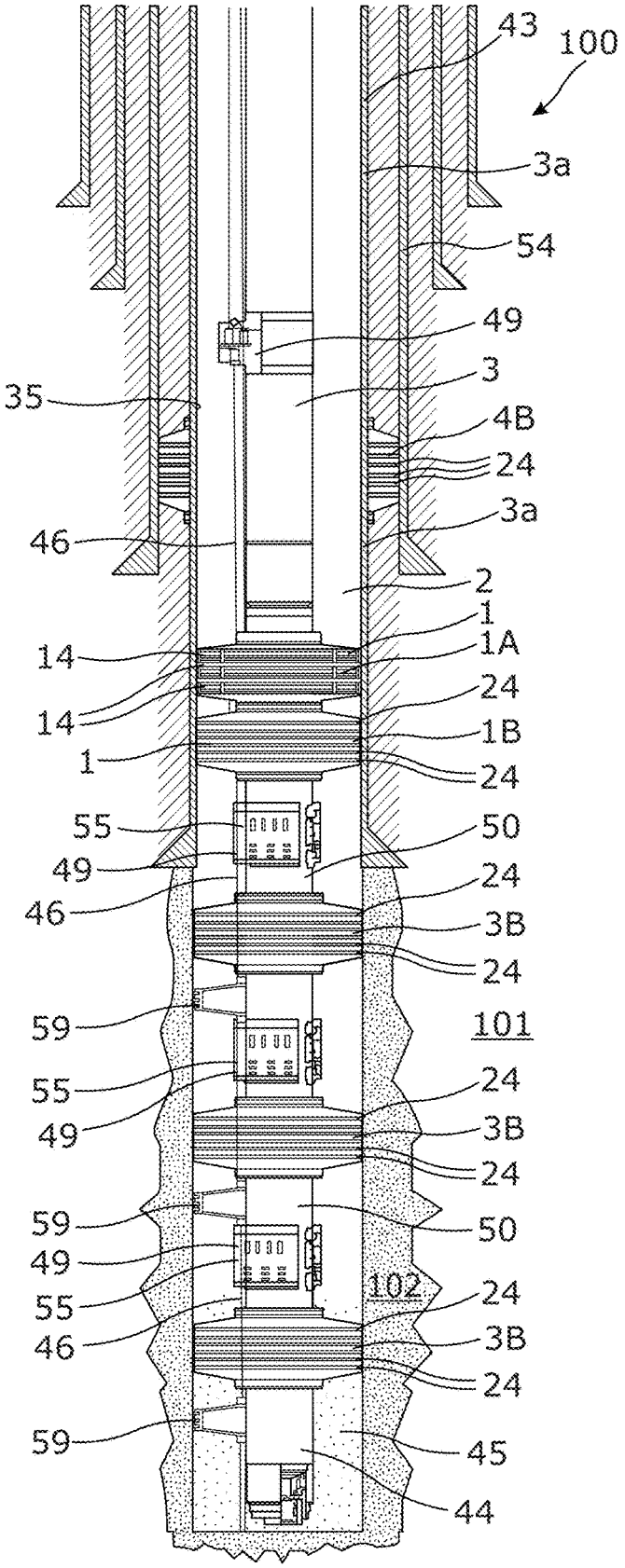
Figure 7:
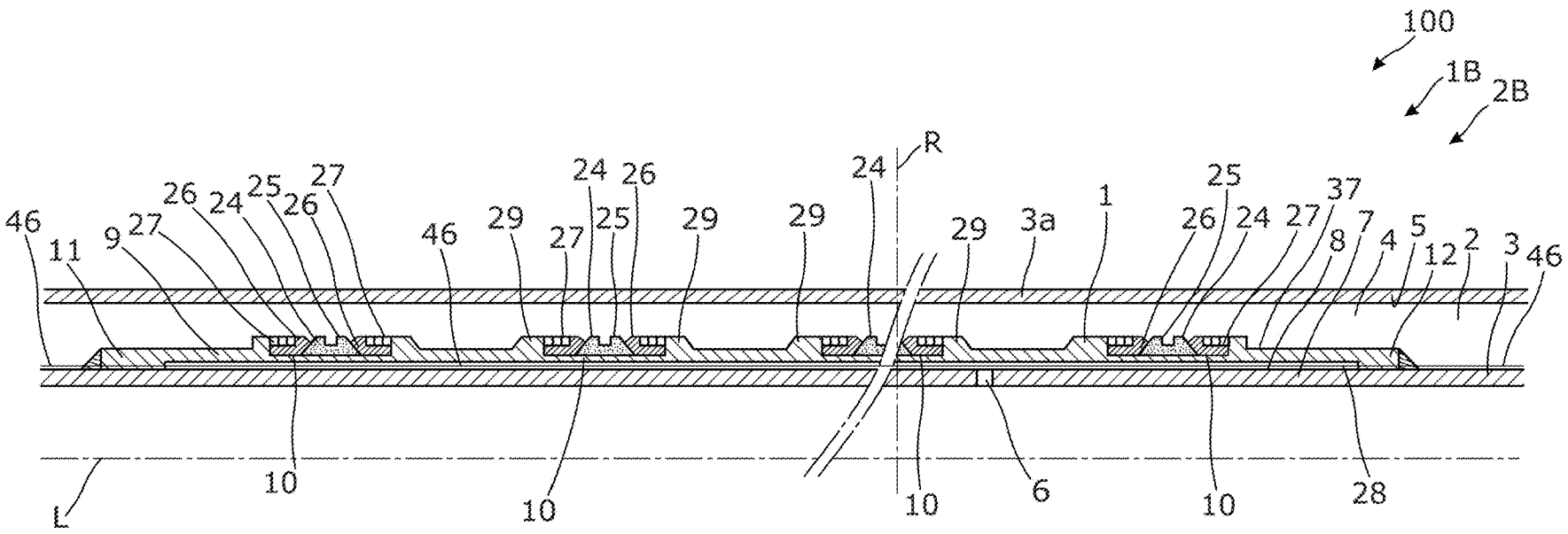
Figure 8:
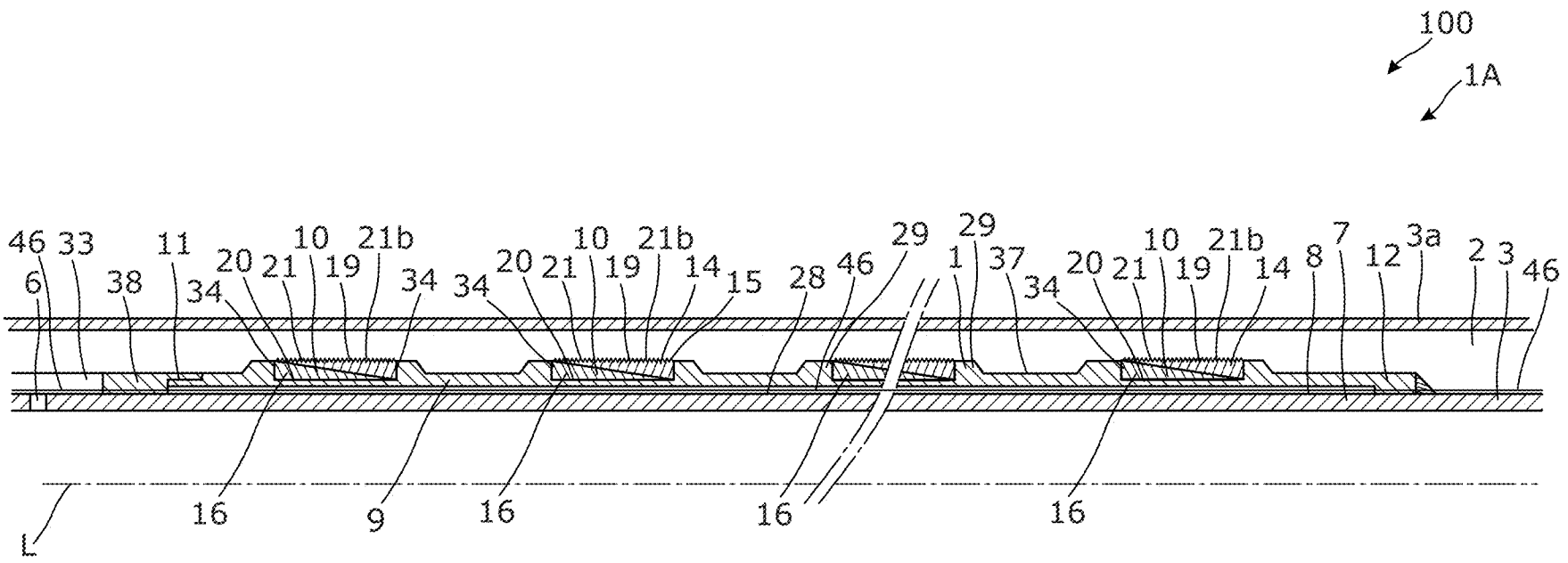
Figure 9:
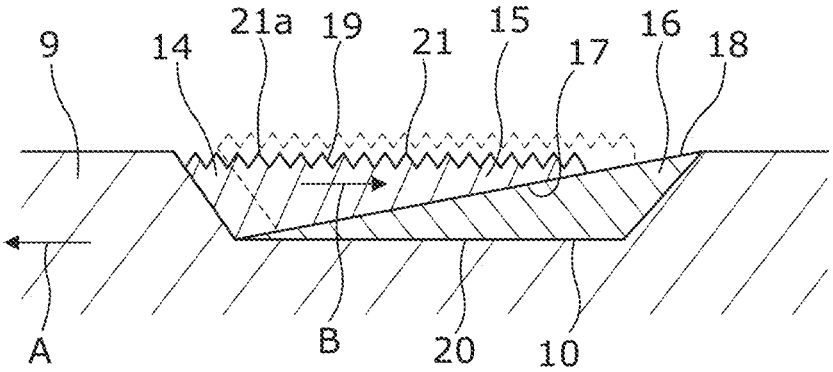
Figure 10:
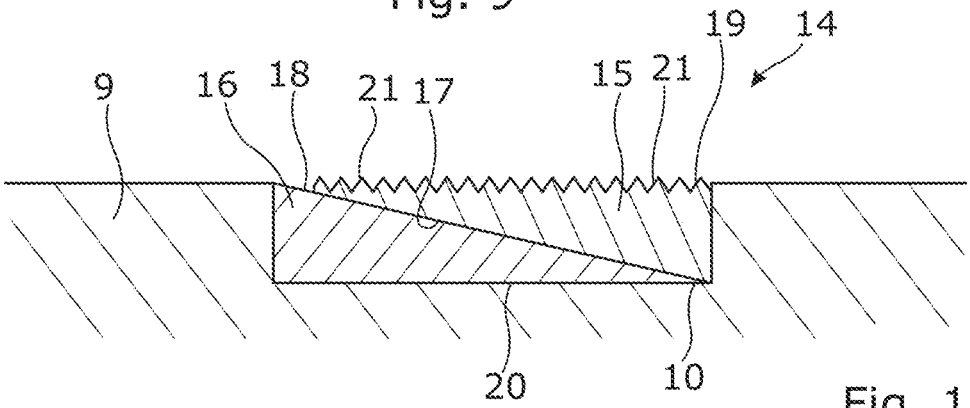
Figure 11:
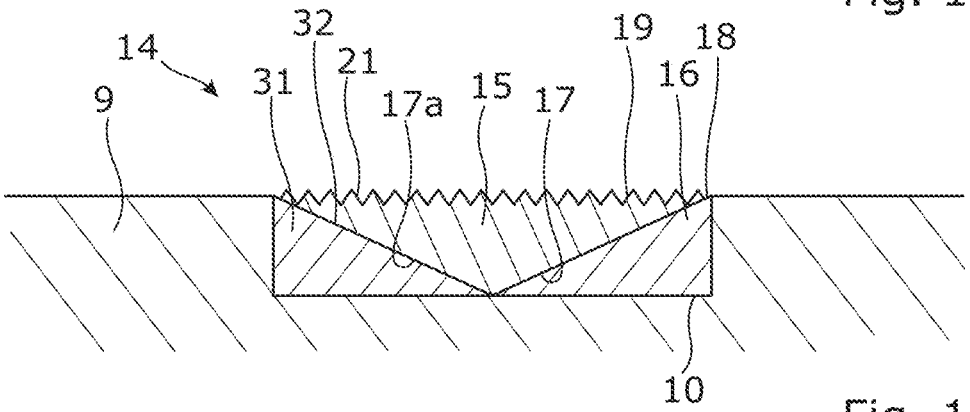
Figure 12:
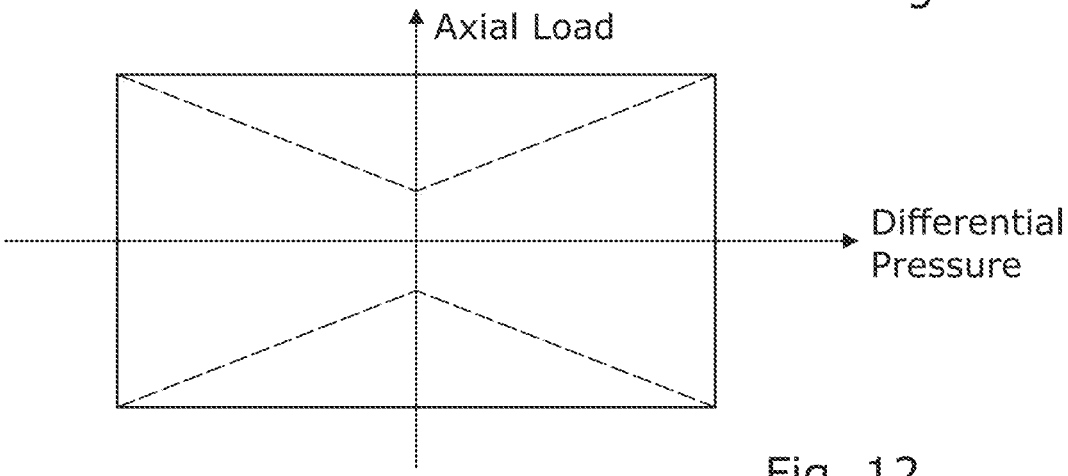
Figure 13:
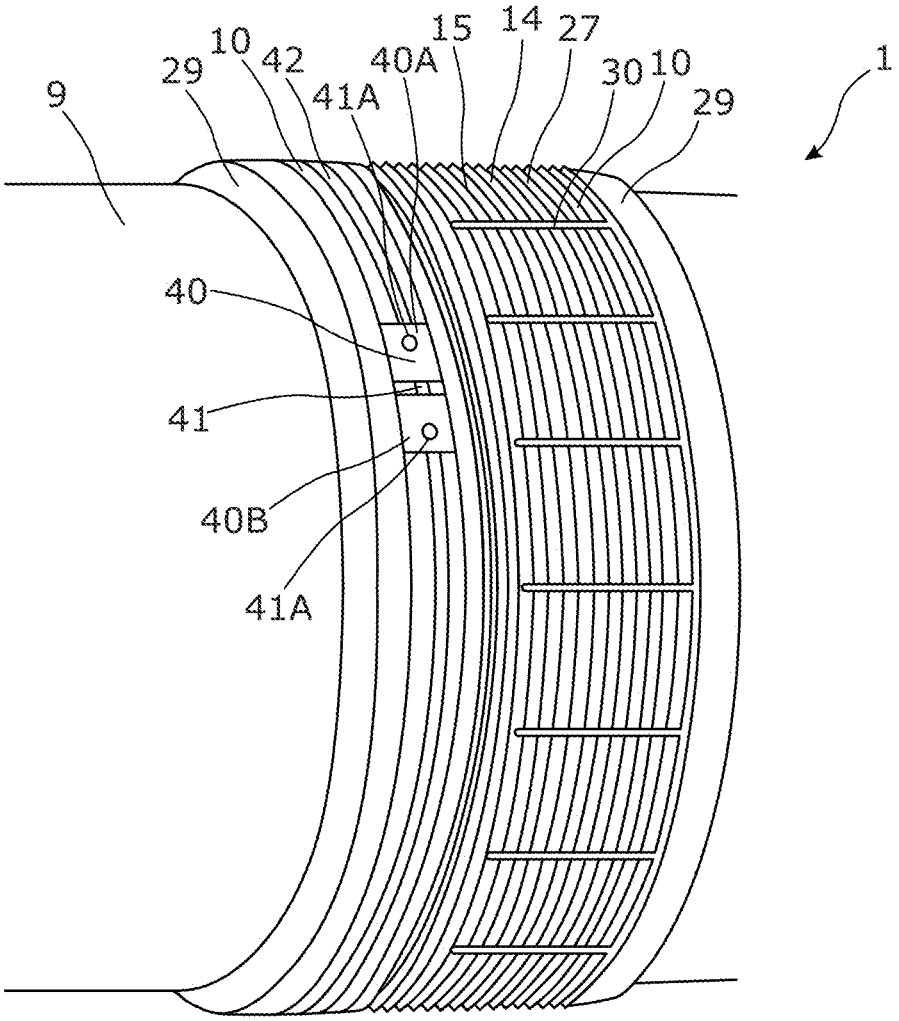
Figure 14:
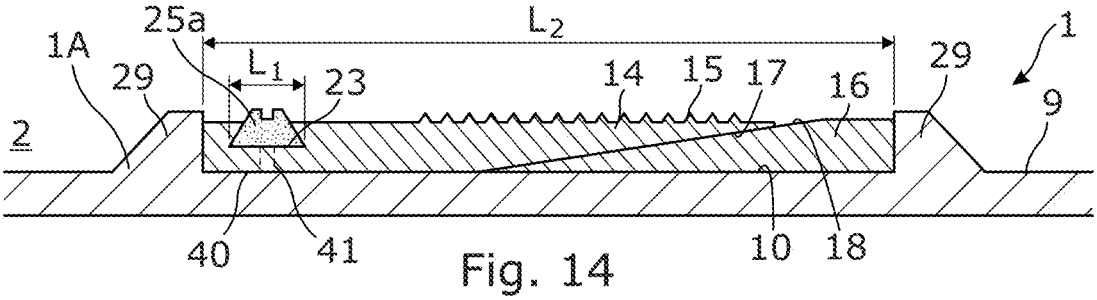
Figure 15:
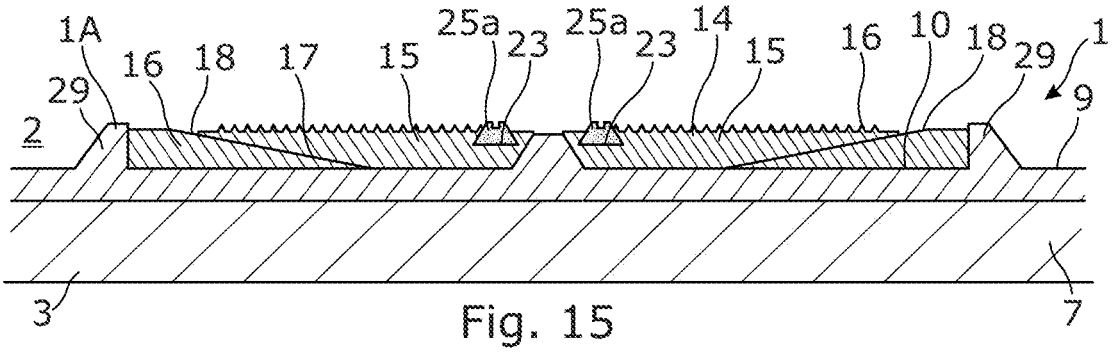
Figure 16A:
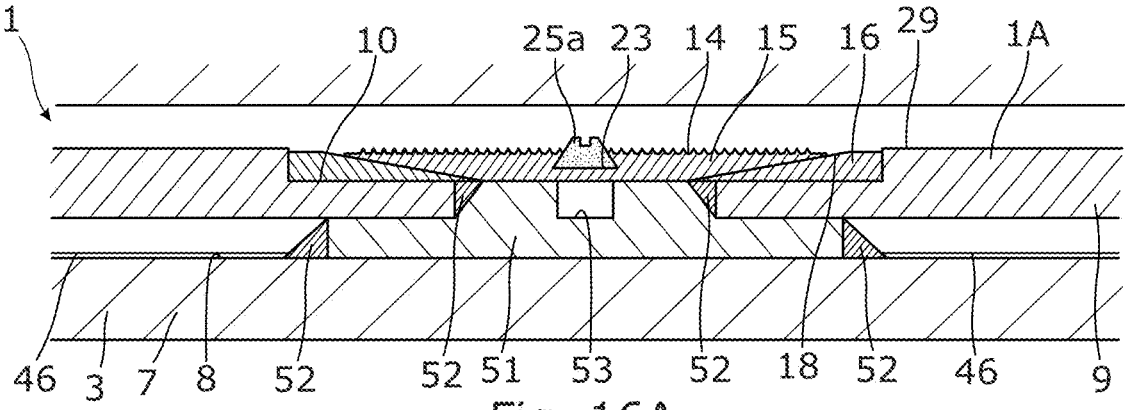
Figure 16B:
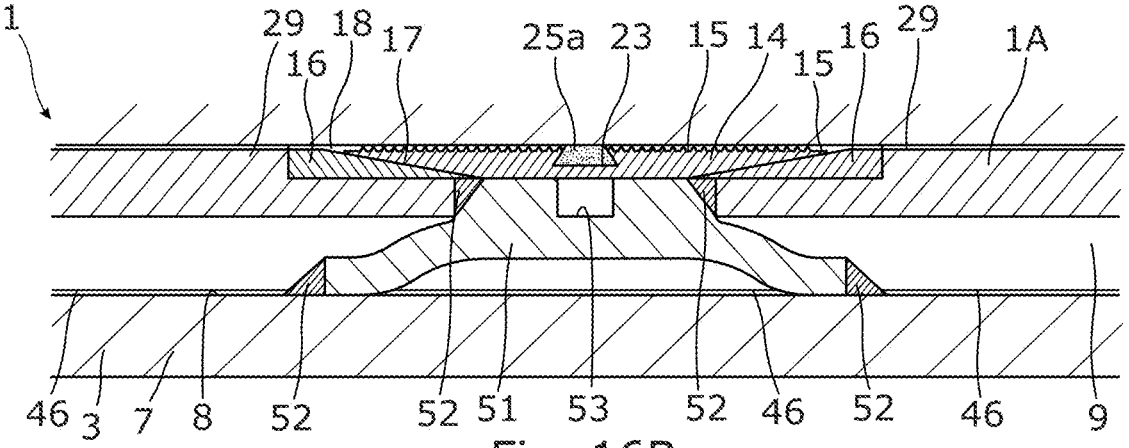

The invention and its many advantages will be described in more detail below with reference to the accompanying schematic drawings, which for the purpose of illustration show some non-limiting embodiments and in which:

FIG. 1 shows a cross-sectional view of a prior art completion with a liner hanger C, a liner hanger packer LP, an optic fibre O and a production packer PP, FIG. 2 shows a cross-sectional view of a completion system ready for $CO_2$ storage monitoring, FIG. 3A shows a cross-sectional view of another completion system, FIG. 3B shows a cross-sectional view of the completion of FIG. 3A where a plug has been set below a flow control assembly through which fluid is flowing for cleaning the annulus, FIG. 3C shows a cross-sectional view of the completion of FIG. 3B where pressurised fluid through the second well tubular metal structure sets the production packer, FIG. 4A shows a cross-sectional view of yet another completion system, FIG. 4B shows a cross-sectional view of the completion of FIG. 4A where a plug has been set below a second annular barrier unit which is set by pressurised fluid in the second well tubular metal structure, FIG. 4C shows a cross-sectional view of the completion of FIG. 4A where fluid is flowed through the flow control assembly for cleaning the annulus, FIG. 4D shows a cross-sectional view of the completion of FIG. 4A where pressurised fluid through the second well tubular metal structure sets the production packer, FIG. 5 shows a cross-sectional view of another completion system, FIG. 6 shows a cross-sectional view of yet another completion system, FIG. 7 shows a cross-sectional view of an annular barrier unit having sealing elements, FIG. 8 shows a cross-sectional view of an anchoring unit having anchoring elements, FIG. 9 shows a cross-sectional view of part of an expandable metal sleeve having a groove in which an anchoring element is arranged, FIG. 10 shows a cross-sectional view of part of another expandable metal sleeve having a groove in which another anchoring element with an inclination in an opposite direction of the anchoring element shown in FIG. 9 is arranged, FIG. 11 shows a cross-sectional view of part of yet another expandable metal sleeve having a groove in which another anchoring element comprises a first, second and third anchoring part, FIG. 12 is a schematic diagram of the axial load on an anchoring unit in relation to differential pressure across the expandable metal sleeve, FIG. 13 shows a perspective of part of an anchoring unit having an anchoring element, FIG. 14 shows a cross-sectional view of part of yet another expandable metal sleeve having an anchoring element with a fixation element incorporated in the sealing element, FIG. 15 shows a cross-sectional view of part of yet another expandable metal sleeve having a groove in which two opposite-facing anchoring elements are arranged, FIG. 16A shows a cross-sectional view of part of yet another unexpanded expandable metal sleeve having a groove in which an anchoring element comprising two second anchoring parts is arranged, and FIG. 16B shows the expandable metal sleeve of FIG. 16A in an expanded condition.

All the figures are highly schematic and not necessarily to scale, and they show only those parts which are necessary in order to elucidate the invention, other parts being omitted or merely suggested.

FIG. 2 shows a completion system 100 for hydrocarbon production from a well, which system is ready for $CO_2$ storage monitoring of a reservoir 101 in a formation 102 when the well has stopped being productive. The completion system 100 may also be made as a monitoring completion system and thus from the beginning be made as a monitoring well for $CO_2$ storage monitoring of the $CO_2$-containing reservoir 101. The completion system 100 is arranged in a borehole 4 having a top 103 and extending towards the reservoir 101. The completion system 100 comprises a first well tubular metal structure 3*a* having a first inner diameter ID1 and a second well tubular metal structure 3 having a first part 43 arranged within the first inner diameter ID1 of the first well tubular metal structure 3*a* and a second part 44 extending below the first well tubular metal structure 3*a* into the borehole 4. The completion system 100 further comprises cement 45 arranged between the borehole 4 and the second part 44 of the second well tubular metal structure 3, and a monitoring line 46, such as a fibre optic line, an electric line or a similar line extending from the top 103 along both the first and second parts 43, 44 of the second well tubular metal structure 3 and into the cement 45. A production packer assembly 1 provides a seal between the first well tubular metal structure 3*a* and the first part 43 of the second well tubular metal structure 3, where the production packer assembly 1 comprises an anchoring unit 1A and an annular barrier unit 1B.

Each unit comprises a tubular metal part 7 configured to be mounted as part of the first part 43 of the second well tubular metal structure 3, the tubular metal part 7 having an outer face 8, an opening 6 and an axial extension L along the second well tubular metal structure 3. Each unit further comprises an expandable metal sleeve 9 surrounding the tubular metal part 7. The expandable metal sleeves 9 of the anchoring unit 1A shown in FIG. 8 and the annular barrier unit 1B shown in FIG. 7 have several circumferential grooves 10, a first end 11 and a second end 12, and each end of the expandable metal sleeve is connected with the outer face 8 of the tubular metal part 7. The anchoring unit 1A further comprises an anchoring element 14 arranged in the circumferential groove 10, the anchoring element 14 comprising a first anchoring part 15 at least partly overlapping a second anchoring part 16 in a radial direction perpendicular to the axial extension L so that an inner face 17 of the first anchoring part 15 at least partly abuts an outer face 18 of the second anchoring part 16. The annular barrier unit 1B further comprises a sealing element 24 arranged in the circumferential groove 10. The monitoring line 46 extends through both the anchoring unit 1A and the annular barrier unit 1B between the tubular metal part 7 and the expandable metal sleeve 9.

By having a monitoring line 46, such as a fibre optic line, Real Time Monitoring in the reservoir section behind the cemented casing is possible, which is very useful from the perspective of $CO_2$ storage. In that way, the following can be monitored: 1) Cap rock integrity, 2) X-flow, channeling, etc., 3) Casing/Tubing leak detection, 4) Cement integrity, 5) X-flow in reservoir layers, 6) Microseismical surveillance, 7) Plume migration monitoring, 8) Distributed Temperature Sensing, 9) Distributed Strain Sensing of the rock (subsidence, uplifts, etc.), 10) Rock Imaging, and 11) Well barrier MMV.

The completion system 100 may not comprise cement 45 arranged between the borehole 4 and the second part 44 of the second well tubular metal structure 3. A monitoring line 46, such as a fibre optic line, an electric line or a similar line, extends from the top 103 along both the first and second parts 43, 44 of the second well tubular metal structure 3. By having a production packer assembly 1 with an anchoring unit 1A and an annular barrier unit 1B having expandable metal sleeves 9 and a monitoring line 46, such as fibre optic or electric lines, extending through both the anchoring unit 1A and the annular barrier unit 1B between the tubular metal part 7 and the expandable metal sleeve 9, the production casing, i.e. the first well tubular metal structure 3*a*, does not have to be flushed with brine after drilling, soiling the completion, and the production casing from within as the production packer assembly 1 can be set in any dirty production casing. The expandable metal sleeve 9 of the anchoring unit 1B having an anchoring element 14, and the expandable metal sleeve 9 of the annular barrier unit 1B having a sealing element 24, both the anchoring unit 1A and the annular barrier unit 1B can be set in a non-cleaned production casing where the prior art production packer cannot.

As shown in FIG. 3, the completion system 100 is made according to a completion method for completing a well to be ready for $CO_2$ storage monitoring of the reservoir 101 in the formation 102 by introducing the first well tubular metal structure 3*a*, mounting the second well tubular metal structure 3 with the monitoring line 46 extending along both the first and second parts 43, 44 of the second well tubular metal structure 3, and mounting the tubular metal part 7 of the anchoring unit 1A and the annular barrier unit 1B to form part of the second well tubular metal structure 3. Further, the completion method comprises introducing the second well tubular metal structure 3 with the production packer assembly 1 and the monitoring line 46, the second well tubular metal structure 3 being arranged within the first inner diameter ID1 of the first well tubular metal structure 3*a*, and the second part 44 extending below the first well tubular metal structure 3*a* into the borehole 4. Cement 45 is then run down the second well tubular metal structure 3 and out through the bottom and forced to flow upwards between the borehole 4 and the second part 44 of the second well tubular metal structure 3. Next, the production packer assembly 1 is set by pressurising fluid in the second well tubular metal structure 3 and letting the fluid into the openings 6 of the anchoring unit 1A and the annular barrier unit 1B, thereby expanding the expandable metal sleeve 9 so that the sealing element 24 of the annular barrier unit 1B and the anchoring element 14 of the anchoring unit 1A abut against the inner face of the first well tubular metal structure 3*a*. Before the production packer assembly 1 is set, a plug 56 may be set to isolate the first part 43 of the second well tubular metal structure 3 from the second part 44. As shown, the monitoring line 46 is fixedly connected to an outer face 50 of the second well tubular metal structure 3 by clamps 49 so that the cement 45 does not move the monitoring line 46 upwards.

By having a production packer assembly 1 settable by fluid pressure from within the second well tubular metal structure 3, the monitoring line 46 can extend therethrough between the tubular metal part 7 and the expandable metal sleeve 9. The production packer assembly 1 can thus be used and set after cementing the lower part around the second part 44 of the second well tubular metal structure 3 without the use of a liner and a liner hanger. Thereby, the production packer assembly 1 can be part of the same well tubular metal structure as the cemented part, and the completion system is completable in one run since no further runs are necessary for setting the liner hanger, disconnecting and pulling out the running tool, inserting the upper production casing and setting the production packer. Since the inner tubing is not made as two separate casings, such as the lower liner and the upper production casing, the monitoring line 46 can extend all the way down through the cement 45 so that the completion system 100 is ready for $CO_2$ storage monitoring of the reservoir 101. The monitoring line 46 is able to measure strain caused by any slight movement in the reservoir 101 as the cement 45 will then put pressure on the monitoring line 46. This strain can be detected at surface, and thus the completion system can be used for $CO_2$ storage monitoring of a $CO_2$-containing reservoir.

Prior art production packers are not approved for being run in with the tubing through which the cement job is performed since the internal surface of the intermediate casing against which the production packer is to seal is no longer clean enough for the known production packers to be sealingly set. Therefore, known cemented wells as shown in FIG. 1 need to be designed with a liner C run in the intermediate casing with a running tool and connected to surface via a drill pipe. The cement is then pumped down the drill pipe and the liner so that the cement does not contact the inner surface of an intermediate casing I. After cement has been put around the liner, the liner is hung off from the intermediate casing I in a liner packer LP, and the running tool and the drill pipe are disconnected. Then a production casing PC with a production packer PP is run in and connected with the top of the liner, and the production packer is set between the intermediate casing and the clean inner face of the intermediate casing.

As shown in FIGS. 3A-C, the completion system 100 further comprises a flow control assembly 39 fluidly connected to an aperture 47 in the first part 43 of the second well tubular metal structure 3 for controlling the flow of fluid from an inside 48 of the second well tubular metal structure 3 and to an annulus 2 between the first and the second well tubular metal structure. The flow control assembly 39 is arranged below the production packer assembly 1. The flow control assembly 39 may comprise a sliding sleeve activated through the fibre-optic line 46 or by submerging a tool. In FIG. 3B, a plug 56 has been set in the second well tubular metal structure 3 before fluid is let through the aperture 47 of the flow control assembly 39 to clean the annulus 2 between the first and the second well tubular metal structure 3, 3*a*. Then in FIG. 3C, the flow control assembly 39 has been closed, and the production packer assembly 1 is set by letting pressurised fluid down the inside 48 of the second well tubular metal structure 3 and out through openings 6 in the tubular metal part 7 to expand the expandable metal sleeves 9 to abut the inner face 17 of the first well tubular metal structure 3*a*. After having set the production packer assembly 1, the plug 56 may be removed so that the completion system 100 is ready to use. The completion of the completion system 100 can thus be set with the monitoring line 46 extending from the top 103 of the well to the bottom of the borehole 4 and thus be ready for $CO_2$ storage monitoring of the $CO_2$-containing reservoir even when comprising the flow control assembly 39.

As shown in FIG. 3B, the second part 44 of the second well tubular metal structure 3 has a first length L1, and the monitoring line 46 extends along the second part 44 along at least 60% of the first length L1, preferably at least 80% of the first length L1.

In FIG. 4A, the annular barrier unit 1B is a first annular barrier unit 1B, and the completion system 100 further comprises a second annular barrier unit 2B arranged further down the first part 43 of the second well tubular metal structure 3 than the first annular barrier unit 1B for providing a seal between the first and the second well tubular metal structure 3*a*, 3. As in FIG. 2, the second well tubular metal structure 3 shown in FIGS. 3A-3C is mounted with the external monitoring line 46 by clamps 49 before being run into the first well tubular metal structure 3*a*, and subsequently the cement 45 is pumped down the second well tubular metal structure 3 and into the borehole 4. The second annular barrier unit 2B provides a second barrier against the cement 45 arranged below the first well tubular metal structure 3*a* when expanded as shown in FIG. 4B. Before pressurising the inside of the second well tubular metal structure 3, a plug 56 is set, plugging off the second part 44 of the second well tubular metal structure 3 as shown in FIG. 4B. Then the annulus 2 is flushed with cleaning fluid through the flow control assembly 39 as shown in FIG. 4C. The flow control assembly 39 is arranged between the production packer assembly 1 and the second annular barrier unit 2B so that the second annular barrier unit 2B protects the cement 45 from the cleaning process. Subsequently, the production packer assembly 1 is set to seal against the first well tubular metal structure 3*a* by letting pressurised fluid from the inside 48 of the second well tubular metal structure 3 into the openings 6 of the tubular metal parts 7 of both the anchoring unit 1A and the annular barrier unit 1B until the expandable metal sleeves 9 thereof abut the inner face 35 of the first well tubular metal structure 3*a*.

In FIG. 5, the completion system 100 further comprises an intermediate casing 54 having a second length L2 and arranged to circumferent the first well tubular metal structure 3*a*, the intermediate casing 54 extending from the top along at least 50% of the second length L2. The completion system 100 also comprises a third annular barrier unit 3B arranged so that the tubular metal part 7 thereof is mounted as part of the second part 44 of the second well tubular metal structure 3 and between the intermediate casing 54 and the first well tubular metal structure 3*a*. The third annular barrier unit 3B is expanded in the non-cured cement 45 so that when curing, the cement 45 sets around the expanded expandable metal sleeve 9 of the third annular barrier unit 3B. The completion system 100 moreover comprises a second monitoring line 46 extending along the second well tubular metal structure 3. The completion system 100 further comprises other annular barrier units 3B so that the tubular metal parts 7 thereof form part of the second part 44 of the second well tubular metal structure 3. As shown in FIG. 5, the other annular barrier units 3B may be set in the openhole part of the borehole 4 below the first well tubular metal structure 3*a* and be set in the cement 45 before the cement has cured. The completion system 100 also comprises a fourth annular barrier unit 4B so that the tubular metal part 7 thereof forms part of the first well tubular metal structure 3*a*, and the expandable metal sleeve 9 is expanded before the surrounding cement 45 has cured and before the second well tubular metal structure 3 is run in. Thus, before arranging the second well tubular metal structure 3 in the first well tubular metal structure 3*a*, the first well tubular metal structure 3*a* is pressurised so that fluid flows in through an opening 6 in the tubular metal part 7 of the fourth annular barrier unit 4B, expanding the expandable metal sleeve 9 to abut the intermediate casing 54. The second well tubular metal structure 3 comprises perforations 58 which are made after the cement 45 has cured. As shown, the completion system 100 moreover comprises a temperature/pressure sensor 57.

The completion system 100 of FIG. 6 further comprises a flow valve 55 mounted as part of the second well tubular metal structure 3 so that production fluid from the reservoir 101 flows into the second well tubular metal structure 3. The second part 44 of the second well tubular metal structure 3 is only partly surrounded by the cement 45 in the lower part so that movements in the reservoir 101 during the storing of $CO_2$ can be monitored, while still having a completion where the production fluid flows in through the flow valves 55. The completion system 100 further comprises a strain sensor 59 for measuring any movements higher up in the borehole 4. For illustrative purposes, the anchoring unit 1A and the annular barrier unit 1B are not shown to scale in FIGS. 5 and 6 as each of the expandable metal sleeves of the units is shown as expanded to a larger degree i.e. to a larger outer diameter than is possible. The expandable metal sleeves should be much longer than what is shown in order to be able to expand radially as much as is shown in FIGS. 5 and 6. In FIG. 7, the more correct dimensions between length of the expandable metal sleeve and the radial distance to the inner wall 5 of the first well tubular metal structure 3*a* is shown.

FIG. 7 shows a cross-sectional view of an annular barrier unit 1B in an unexpanded condition for providing zonal isolation in the annulus 2 downhole between the first well tubular metal structure 3*a* and the second well tubular metal structure 3 or the wall 5 of the borehole 4, as shown in FIG. 5 or 6. The annular barrier unit 1B comprises the tubular metal part 7 mounted as part of the second well tubular metal structure 3. The tubular metal part 7 has then outer face 8, the opening 6 and the axial extension L along the second well tubular metal structure 3. The annular barrier unit 1B comprises the expandable metal sleeve 9 surrounding the tubular metal part 7, where the expandable metal sleeve 9 has the circumferential groove 10 between projections 29, the first end 11 and the second end 12, and each end of the expandable metal sleeve 9 is connected with the outer face 8 of the tubular metal part 7. The annular barrier unit 1B further comprises several sealing elements 24, each arranged in the circumferential groove 10. The monitoring line 46 extends through the annular barrier unit 1B between the expandable metal sleeve 9 and the tubular metal part 7. The sealing element 24 comprises a sealing element part 25 made of e.g. elastomer or polymer, a back-up ring-shaped element 26 on each side of the sealing element part 25 and a key ring element 27 surrounding part of the back-up ring-shaped element 26.

Each end of the expandable metal sleeve 9 is connected with the outer face 8 of the tubular metal part 7, e.g. by means of a connection part and/or by welding as shown in FIG. 8. In FIG. 8, the anchoring unit 1A of the production packer assembly 1 further comprises a valve assembly 33 fluidly connected with the opening 6 and the expandable space 28 so as to fluidly connect the opening 6 and the expandable space 28 during expansion of the expandable metal sleeve 9 and close the fluid connection after the expandable metal sleeve 9 has been properly expanded. The valve assembly 33 may in the second position open for a fluid connection between the annulus 2 and the expandable space 28 in order to equalize the pressure therebetween.

FIG. 8 shows an anchoring unit 1A of the production packer assembly 1 having the anchoring elements 14 in grooves 10 between the projections 29, the anchoring elements comprising the first anchoring part 15 at least partly overlapping the second anchoring part 16 in a radial direction perpendicular to the axial extension L so that the inner face 17 of the first anchoring part 15 at least partly abuts the outer face 18 of the second anchoring part 16. The anchoring element 14 is a circumferential anchoring element extending all the way around the expandable metal sleeve 9, and the anchoring element 14 may be slit so that the anchoring element 14 can be mounted in the circumferential groove 10.

In FIG. 8, the first anchoring part 15 forms one monolithic whole, and the second anchoring part 16 forms a second monolithic whole. The first anchoring part 15 is shaped as a first slit ring, and the second anchoring part 16 is shaped as a second slit ring so that it can be widened and thus be mounted in the circumferential groove 10. First, the second anchoring part 16 is widened and moved along an outer face 37 of the expandable metal sleeve 9 and into the circumferential groove 10, and then the first anchoring part 15 is widened and moved along the outer face 37 of the expandable metal sleeve 9 until reaching the circumferential groove 10 and being arranged to circumferent the second anchoring part 16 so that the inclined inner face 17 of the first anchoring part 15 and the inclined outer face 18 of the second anchoring part 16 abut. The first anchoring part 15 further comprises an outer face 19 comprising friction-enhancing means 21, such as spikes 21*b*.

In order to provide increased anchoring during axial load, the inner face 17 of the first anchoring part 15 and the outer face 18 of the second anchoring part 16 are inclined in relation to the axial extension L. Thus, when the temperature changes, and at least part of the expandable metal sleeve 9 moves in one direction along the axial extension L, as indicated with arrow A in FIG. 9, the first anchoring part 15 moves in an opposite direction along the inclined outer face 18 of the second anchoring part 16, as indicated with arrow B in FIG. 9, and the first anchoring part 15 is then forced radially outwards, as indicated with dashed lines, anchoring the expandable metal sleeve 9 even further to another well tubular metal structure 3*b* (shown in FIG. 8) or the wall 5 of the borehole 4.

In the diagram of FIG. 12, the axial load on the anchoring unit 1A as a function of the differential pressure is illustrated with full lines. By having an anchoring unit 1A of the production packer assembly 1 according to the invention, the axial load is not reduced when the differential pressure is low as in prior art annular barriers, which is indicated by dotted lines.

In FIG. 11, the anchoring element 14 comprises a third anchoring part 31 having an outer face 32 abutting a second inner face 17*a* of the first anchoring part 15 so that the first anchoring part 15 is arranged between the third anchoring part 31 and the second anchoring part 16, and an inner face 36 of the third anchoring part 31 and the inner face 20 of the second anchoring part 16 face and abut the circumferential groove 10. Thus, the anchoring unit 1A and the production packer assembly 1 can withstand axial loads in both directions along the axial extension L as the first anchoring part 15 of the anchoring elements 14 is activated when the axial load is in one direction, and the first anchoring part 15 of the anchoring elements 14 is moved in the other direction when the axial load pulls in the opposite direction.

FIG. 13 shows a perspective of a part of another anchoring unit of the production packer assembly 1. In order to ensure that the first anchoring part 15 and the second anchoring part 16 of the anchoring element 14 do not slide prematurely in relation to each other, a fixation unit 40 is arranged in the circumferential groove 10, i.e. in a groove 23 of the first anchoring part 15 so that the first anchoring part 15 and the second anchoring part 16 cannot slide in relation to each other. The fixation unit 40 comprises a ring-shaped part 42 extending all the way around the expandable metal sleeve 9, and each end of the ring-shaped part 42 is connected with a breakable element 41. The ring-shaped part 42 is a sealing element 25*a* made of e.g. elastomer or polymer, where the sealing element 25*a* is cut, and each end is connected with a breakable element 41 by means of connection parts 40A, 40B. When expanding the expandable metal sleeve 9, the breakable element 41 breaks, and then the first anchoring part 15 and the second anchoring part 16 are able to slide in relation to each other. The first anchoring part 15 has slits 30 in order to provide a more flexible first anchoring part 15. Instead of the breakable element 41, the connection parts 40A, 40B may also be fastened to the first anchoring part 15 by means of pins 41A, which break during expansion of the expandable metal sleeve 9. In FIG. 14, the breakable element 41 is shown in the position of the pin 41A and is breaking during expansion. The sealing element 25*a* is connected with the breakable element 41 by means of at least one connection part through which the breakable element 41 in the form of the pin 41A extends and extends further into a bore in the first anchoring part 15, forming the fixation unit 40. Once the expandable metal sleeve 9 has expanded and broken, the first anchoring part 15 is free to slide in relation to the second anchoring part 16 when the second well tubular metal structure 3 is subjected to the axial load, i.e. an axial movement of the first well tubular metal structure 3*a* in relation to the second well tubular metal structure 3.

As can be seen in FIG. 14, the groove 23 has a first length L1 along the axial extension L, and the first anchoring part 15 has a second length L2 along the axial extension L, where the first length L1 is at least 10% of the second length L2, and preferably at least 20% of the second length L2.

In FIGS. 16A, 16B, the expandable metal sleeve 9 is fastened to the tubular metal part 7 of the second well tubular metal structure 3 by means of a connection element 51 which is fastened to the tubular metal part 7 by welded connections 52 and welded to two parts of the expandable metal sleeve 9 by the welded connections 52. The anchoring element 14 is arranged opposite the connection element 51 in the circumferential groove 10 formed by the two parts of the expandable metal sleeve 9 and the connection element 51. During expansion of the expandable metal sleeve 9, the connection element 51 expands as shown in FIG. 16B, pressing the anchoring element 14 radially outwards so as to enhance the function of the anchoring element 14 after expansion has ended. The connection element 51 has a groove 53 in which a projection of the first anchoring part 15 may extend, or the groove 53 will make room for welding to provide proper fastening of the first anchoring part 15 to the connection element 51. The expandable metal sleeve 9 is expanded until the first anchoring part 15 abuts the inner face 35 of the first well tubular metal structure 3 as shown in FIG. 16B. The monitoring line 46 extends through the anchoring unit 1A between the tubular metal part 7 and indentations in the connection element 51.

Although the invention has been described above in connection with preferred embodiments of the invention, it will be evident to a person skilled in the art that several modifications are conceivable without departing from the invention as defined by the following claims.

The invention claimed is:

1. A completion system for $CO_2$ storage monitoring in a reservoir in a formation, the completion system being arranged in a borehole having a top and extending towards the reservoir, the completion system comprising:

a first well tubular metal structure having a first inner diameter, a second well tubular metal structure having a first part arranged within the first inner diameter of the first well tubular metal structure and a second part extending below the first well tubular metal structure into the borehole, a monitoring line extending from the top along both the first and second part of the second well tubular metal structure and into cement, and a production packer assembly providing a seal between the first well tubular metal structure and the first part of the second well tubular metal structure, the production packer assembly comprising:

an anchoring unit, and an annular barrier unit, wherein the annular barrier unit comprises:

a tubular metal part configured to be mounted as part of the first part of the second well tubular metal structure, the tubular metal part having an outer face, and an axial extension along the second well tubular metal structure, and an expandable metal sleeve surrounding the tubular metal part, the expandable metal sleeve having a circumferential groove, a first end and a second end, each end of the expandable metal sleeve being connected with the outer face of the tubular metal part, the tubular metal part comprising an opening through which fluid passes to expand the expandable metal sleeve, wherein the anchoring unit further comprises an anchoring element arranged in the circumferential groove, the anchoring element comprising a first anchoring part at least partly overlapping a second anchoring part in a radial direction perpendicular to the axial extension so that an inner face of the first anchoring part at least partly abuts an outer face of the second anchoring part, wherein the annular barrier unit further comprises a sealing element arranged in the circumferential groove, and wherein the monitoring line extends through both the anchoring unit and the annular barrier unit between the tubular metal part and the expandable metal sleeve.

2. A completion system according to claim 1, wherein the annular barrier unit is a first annular barrier unit, and the completion system further comprises a second annular barrier unit arranged further down the first part than the first annular barrier unit for providing a seal between the first and the second well tubular metal structure.

3. A completion system according to claim 2, further comprising a third annular barrier unit arranged so that the tubular metal part thereof is mounted as part of the second part of the second well tubular metal structure.

4. A completion system according to claim 3, wherein the expandable metal sleeve of the third annular barrier unit is expanded in non-cured cement.

5. A completion system according to claim 1, further comprising a flow control assembly fluidly connected to an aperture in the first part of the second well tubular metal structure for controlling the flow of fluid from an inside of the second well tubular metal structure to an annulus between the first and the second well tubular metal structure.

6. A completion system according to claim 5, wherein the flow control assembly is arranged between the production packer assembly and a second annular barrier unit arranged further down the first part than the first annular barrier unit for providing a seal between the first and the second well tubular metal structure.

7. A completion system according to claim 1, wherein the second part of the second well tubular metal structure has a first length, and the monitoring line extends along the second part along at least 60% of the first length.

8. A completion system according to claim 1, wherein the second well tubular metal structure comprises clamps for fastening the monitoring line to an outer face of the second well tubular metal structure.

9. A completion system according to claim 1, further comprising a second monitoring line extending along the second well tubular metal structure.

10. A completion system according to claim 1, further comprising an intermediate casing having a second length and arranged to be circumferenting the first well tubular metal structure, the intermediate casing extending from the top along at least 50% of the second length, and a fourth annular barrier unit arranged between the intermediate casing and the first well tubular metal structure.

11. A completion system according to claim 1, further comprising other annular barrier units so that the tubular metal parts thereof form part of the second part of the second well tubular metal structure.

12. A completion system according to claim 1, further comprising a flow valve mounted as part of the second well tubular metal structure so that production fluid from the reservoir flows into the second well tubular metal structure.

13. A completion system according to claim 1, wherein the monitoring line comprises a fiber line or an electric line.

14. A completion method for completing a well to be ready for $CO_2$ storage monitoring in a reservoir in a formation, comprising:

introducing the first well tubular metal structure of the completion system according to claim 1, mounting the second well tubular metal structure with the monitoring line extending along both the first and second parts of the second well tubular metal structure, and mounting the tubular metal part of the anchoring unit and the annular barrier unit to form part of the second well tubular metal structure, introducing the second well tubular metal structure with the production packer assembly and the monitoring line, the second well tubular metal structure being arranged within the first inner diameter of the first well tubular metal structure, and the second part extending below the first well tubular metal structure into the borehole, running cement down the second well tubular metal structure and further between the borehole and the second part of the second well tubular metal structure, and setting the production packer assembly by pressurising fluid in the second well tubular metal structure and letting the fluid into the openings of the anchoring unit and the annular barrier unit, thereby expanding the expandable metal sleeve so that the sealing element of the annular barrier unit and the anchoring element of the anchoring unit abut against an inner face of the first well tubular metal structure.

15. A completion method according to claim 14, before setting the production packer assembly, the completion method comprises cleaning the annulus between the first and the second well tubular metal structure by letting fluid in through an aperture of a flow control assembly arranged below the production packer assembly.

16. A completion method according to claim 14, wherein, before letting fluid in through an aperture of a flow control assembly arranged below the production packer, the completion method may comprise setting a plug inside the second well tubular metal structure below the flow control assembly.

* * * * *